US008406436B2

(12) United States Patent
Craven et al.

(10) Patent No.: US 8,406,436 B2
(45) Date of Patent: Mar. 26, 2013

(54) MICROPHONE ARRAY

(76) Inventors: Peter G. Craven, London (GB); Malcolm Law, Steyning (GB); Chris Travis, Wotton-under-Edge (GB)

( * ) Notice: Subject to any disclaimer, the term of this patent is extended or adjusted under 35 U.S.C. 154(b) by 594 days.

(21) Appl. No.: 12/444,628

(22) PCT Filed: Oct. 5, 2007

(86) PCT No.: PCT/GB2007/003782

§ 371 (c)(1),
(2), (4) Date: May 6, 2009

(87) PCT Pub. No.: WO2008/040991

PCT Pub. Date: Apr. 10, 2008

(65) Prior Publication Data

US 2010/0142732 A1 Jun. 10, 2010

(30) Foreign Application Priority Data

Oct. 6, 2006 (GB) ..... 0619825.3

(51) Int. Cl.
*H04R 25/00* (2006.01)

(52) U.S. Cl. ..... 381/170; 257/91; 257/E51.018

(58) Field of Classification Search ..... 381/170; 257/91, E51.018
See application file for complete search history.

(56) References Cited

U.S. PATENT DOCUMENTS

| | | | | |
|---|---|---|---|---|
| 4,042,779 | A * | 8/1977 | Craven et al. | 381/103 |
| 6,845,163 | B1 * | 1/2005 | Johnston et al. | 381/92 |
| 2004/0120532 | A1 | 6/2004 | Dedieu et al. | |
| 2005/0123149 | A1 * | 6/2005 | Elko et al. | 381/92 |
| 2006/0081050 | A1 | 4/2006 | Workman | |
| 2007/0009116 | A1 * | 1/2007 | Reining | 381/122 |

FOREIGN PATENT DOCUMENTS

| | | | |
|---|---|---|---|
| FR | 2 834 065 | A1 | 6/2003 |
| GB | 1512514 | A1 | 6/1978 |
| WO | 03/061336 | A1 | 7/2003 |

OTHER PUBLICATIONS

"PCT International Search Report", dated May 28, 2008, for PCT/GB2007/003782, 4pgs.

(Continued)

*Primary Examiner* — Eugene Lee
*Assistant Examiner* — Elias M Ullah
(74) *Attorney, Agent, or Firm* — Buckley, Maschoff & Talwalkar LLC

(57) ABSTRACT

A sound capture device comprises a symmetric microphone array that includes non-radially-oriented directional sensors (101). The device typically derives a spherical harmonic representation of the incident sound field, and affords higher signal-to-noise ratios and better directional fidelity than prior arrays, across a wide range of audio frequencies.

48 Claims, 6 Drawing Sheets

OTHER PUBLICATIONS
"SoundField SPS200 Preliminary Information", SoundField Ltd., 2006, 1pg.
Nick Mariette, "Proliferating Ambisonic Microphones", 2006, retrieved date Aug. 14, 2009, web article, download from http://blog.soundsorange.net/2006/11/04/ambisonic-microphones/, 2pgs.
Stephen Thornton, "Tetrahedral Recording", Part 7 of "Michael Gerzon" web article, 2009, download from http://www.michaelgerzonphotos.org.uk/tetrahedral-recording.html, retrieved date Aug. 14, 009, 6pgs.
Eric Benjamin et al., "The Native B-format Microphone: Part 1", Audio Engineering Society Convention Paper 6621, Oct. 7-10, 2005, 15 pgs.
Hans-Elias de Bree et al., "Sound Intensity Probes based on Microflown Technology", ASA, Berlin, 1999, 4pgs.
Zhiyun Li, "The Capture and Recreation of 3D Auditory Scenes", University of Maryland, 2005, 184pgs.

* cited by examiner

MICROPHONE ARRAY

This application is a U.S. National Stage filing under 35 U.S.C. §371 and 35 U.S. §119, based on and claiming priority to PCT/GB2007/003782 for "MICROPHONE ARRAY" filed Oct. 5, 2007, claiming priority to GB Patent Application No. 0619825.3 filed Oct. 6, 2006.

FIELD OF THE INVENTION

The invention relates to the field of microphone arrays, and in particular the synthesis of high order directivities.

BACKGROUND TO THE INVENTION

An acoustic field has two physical characteristics that can be sensed: pressure and velocity. Pressure is a scalar quantity whereas velocity is a vector quantity. Conventional studio microphones sense one of these quantities or a linear combination of the two. An 'omnidirectional' microphone senses pressure, while a 'figure-of-eight' microphone senses velocity (or 'pressure gradient', which is closely related to velocity). Other types (subcardioid, cardioid, supercardioid and hypercardioid) sense a linear combination of pressure and velocity.

A way to express the far-field directional behaviour of a microphone is to expand its angular response into spherical harmonics. This expansion is the spherical equivalent of the more familiar Fourier series expansion of a periodic function of a single variable. Using the notation of Furze and Malham (described in Malham, D., "Second and Third Order Ambisonics—the Furse-Malham Set" http://www.y-ork.ac.uk/inst/mustech/3d_audio/secondor.html) there is a single spherical harmonic of order 0 (zero) denoted by 'W', there are three harmonics of order 1 (one) denoted by 'X', 'Y' and 'Z', five of order 2 (two) denoted by 'R', 'S', 'T', 'U' and 'V', and so on. Pictures of these harmonics may be found in Leese, M. J., "Spherical Harmonic Components" at http://members.tripod.com/martin_leese/Ambisonic/harmonic.html.

The ideal omnidirectional microphone has a response independent of angle and is thus proportional to the zeroth-order harmonic W. The ideal figure-of-eight microphone has a response that is given by a linear combination of the three first-order harmonics X, Y and Z. The coefficients of the combination depend on the orientation of the microphone. Microphones of type 'cardioid' and its variants have a response that is a combination of W, X, Y and Z. All normal studio microphones are classified as 'first order' because their responses are linear combinations of harmonics of order 0 and 1.

If a microphone directivity could be synthesised using second order or higher order components also, then the directional resolution could be increased substantially. However there is no known physical quantity that is associated directly with a second or higher order spherical harmonic. Accordingly, higher-order responses have usually been synthesised using collections of slightly spaced microphone sensors or 'capsules', the outputs from which are processed to synthesise the desired directional response or responses. An early example of this technique is due to Blumlein, A. D. in "Improvements in and relating to Electrical Sound Transmission Systems", British patent 456,444 (1936).

Various geometrical arrangements of microphone capsules are possible, but recently there has been considerable interest in capsules placed on the surface of a sphere. The sphere may exist physically, or merely be conceptual.

In British patent GB1512514 ("Coincident microphone simulation covering three dimensional space and yielding various directional outputs" 1977, filed July 1974), Craven, P. G. and Gerzon, M. A. disclose that the capsules may be placed at the points of a suitable integration rule for the sphere, and an output with spherical harmonic directivity can be obtained by multiplying each capsule output firstly by the value of the spherical harmonic at the capsule's position, and secondly by an integration weight given by the integration rule. This procedure assumes that each capsule is omnidirectional or, if it has directivity (for example cardioid), its direction of maximum sensitivity is pointed radially outward from the centre of the sphere.

There are five completely symmetric integration rules for the sphere, based on the five regular polyhedra or 'Platonic Solids', namely the Regular Tetrahedron, the Regular Hexahedron (cube), the Regular Octahedron, the Regular Dodecahedron and the Regular Icosahedron. In each case the integration rule has the same number of points as there are faces, and we place a microphone capsule at the centre of each face of the polyhedron. This requires 4, 6, 8, 12 and 20 microphone capsules respectively for the five regular polyhedra mentioned. In these symmetrical cases, the weights of the integration rule are all equal, which somewhat simplifies the design of the combining network required to synthesise a particular spherical harmonic.

In such a polyhedral arrangement, the polyhedron may exist physically, or it may be just a conceptual tool to describe the positions of capsules that are suspended in free air, or that are embedded in the surface of a sphere, to give just three examples.

Blumlein's technique for increasing the order of a response can be exemplified by considering two identical omnidirectional capsules separated by a small distance, their outputs being connected to an electrical differencing network. It can be seen that a sound arriving from a direction at right angles to the line joining the two capsules will produce identical outputs from each, and the output of the differencing network will be zero. A sound arriving from along that line will reach one capsule before the other, and the differencing network will thus give a non-zero output on account of the resulting phase difference. Thus a figure-of-eight directional response (or an approximation thereto) is obtained. However at low frequencies, such that the wavelength is long compared with the separation between the capsules, the phase difference will be small and the output of the differencing network will also be small. Blumlein's invention therefore provides for an equaliser to apply bass boost at, ideally, 6 dB/8 ve in order to give a flat frequency response at the final output.

The same principle applies to a spherical, polyhedral or any other arrangement of microphone elements: if the required order of spherical harmonic output is larger than the order provided naturally by the capsules, bass boost is required at 6 dB/8 ve each time the order is increased by one. In particular, to obtain a second order output from zeroth order capsules will require 12 dB/8 ve boost, as described in Rafaely, B., "Design of a Second-Order Soundfield Microphone", Audio Eng. Soc. 118th Convention (Barcelona 2005), AES preprint #6405, although it is of doubtful practicality if a frequency range spanning several octaves is required.

In the 'Soundfield' microphone, the commercial embodiment of the microphone disclosed in GB1512514, large amounts of bass boost are not needed because the required outputs were first order and the individual capsules are also first order (cardioid or sub-cardioid). Nevertheless, equalisation is required at higher frequencies, as is apparent from FIG. 2 of Gerzon, M. A., "The Design of Precisely Coincident Microphone Arrays for Stereo and Surround Sound", Preprint L-20, 50th convention of the Audio Engineering Society (February 1975).

A symmetrical arrangement of capsules is strongly preferred partly because of simplicity of equalisation. It is possible to use an essentially random array of capsules on the surface of a sphere, or even in its volume (as shown in Laborie, A; Bruno, R; Montoya, S, "A New Comprehensive Approach of Surround Sound Recording" Audio Eng. Soc. 114th Convention, February 2003, AES preprint #5717) an d then to solve linear equations in order to determine the correct (complex) weighting factors to apply to each capsule output. However, in principle, these equations need to be solved separately for each required spherical harmonic output and for each frequency, thus requiring a large number of separately-specified equalisers. The symmetrical approach allows, for each required spherical harmonic output, the capsule outputs to be combined in a frequency independent manner, and then an overall equalisation to be applied that is the same for all harmonics of a given order. In some cases, tractable and implementable expressions can be derived for the equalisation, which is virtually impossible in the random case.

Another advantage of a symmetrical arrangement of capsules relates to spatial (directional) aliasing. When a real sound field is expanded into spherical harmonics, the expansion does not stop at a particular order. The microphone wishes to extract specified lower-order harmonics with minimal contamination from other harmonics, especially from harmonics of an order just slightly higher than that the desired harmonic. For example a dodecahedral array can extract an uncontaminated first order harmonic in the presence of other harmonics of order up to four. There are 1+3+5+7+9 =25 harmonics of order 4, and with a random array it would in general be necessary to use at least 25 capsules in order to reject the 24 unwanted harmonics. A dodecahedral array can do this with just 12 capsules.

Heretofore, it has seemed obvious that if first-order, i.e. directional, capsules are used in a symmetrical 3-D arrangement, then each capsule should have its axis of symmetry (and of maximum sensitivity) pointing outwards radially from the centre, for example as shown diagrammatically in FIG. 1. This arrangement does however have a potential disadvantage, that of producing an acoustic cavity, as will now be explained.

Most practical microphone capsules have a drum-like or disc-like shape. In FIG. 1 the capsules are shown well separated for clarity, but in practice it would be desired to move them closer to the centre of the array in order to maintain the directional performance of the array up to the highest audio frequencies. Making the capsules smaller incurs a penalty in signal-to-noise-ratio, so for capsules of a given size the gap between adjacent capsules will become smaller as they are pulled in, perhaps to the point where adjacent capsules touch. This creates an enclosed air space between the capsules, with access to the outside through the relatively small gaps between the capsules. The mass of the air in the gaps will then resonate with the compliance of the enclosed air, creating a Helmholtz resonance near the top of the audio frequency range. The resonance can in principle be equalised, but it is hard to ensure that there will not be residual inaccuracies in the equalisation, leading to audible coloration.

It might be thought that the resonance could be avoided if the enclosed space were filled with solid material of, for example, spherical or polyhedral shape as discussed earlier. This is an attractive solution if pressure sensors are used, but such an acoustic obstruction will modify the air velocity in its vicinity so as to reduce or nullify the velocity sensitivity of first-order sensors, thus worsening the signal-to-noise ratio at low frequencies.

What is needed is a symmetrical arrangement of first-order sensors that avoids the problems noted above.

SUMMARY OF THE INVENTION

According to the present invention, a sound capture device comprises a plurality of microphone capsules disposed around a point of symmetry, including a first set of at least three microphone capsules each having an axis along which it exhibits maximum sensitivity, wherein the axes of the capsules in the first set do not all pass substantially through the point of symmetry and wherein the directions of the axes of the capsules in the first set are not all substantially coplanar.

Preferably, the axes of the capsules in the first set do not all intersect substantially at a common point.

An array of microphone capsules arranged according to the present invention provides for sensitivity in all three dimensions and the synthesis of higher-order directivities. Moreover, the array provides a spherical harmonic representation of an incident sound field with a better signal-to-noise ratio at low frequencies than would be obtained using pressure sensors.

It is preferred that at least three of the axes of maximal sensitivity do not pass substantially through any point of symmetry of the plurality of microphone capsules. More preferably, none of the axes of maximal sensitivity pass substantially through any point of symmetry of the plurality of microphone capsules. Amongst other advantages, this reduces the tendency of the capsules to form an acoustic cavity.

Preferably, the plurality of capsules has at least one axis of rotational symmetry. More preferably, the plurality of capsules has a plurality of axes of rotational symmetry. It is preferred that the disposition of the plurality of capsules has a particularly high degree of symmetry, such as provided by large number of axes of rotational symmetry. This simplifies signal equalization and moderates spatial aliasing.

Any suitable directional microphone may be employed, but it is preferred that the capsule is a velocity sensor having substantially zero response to acoustic pressure. Preferably, at least three capsules in the first set are velocity sensors having substantially zero response to acoustic pressure. More preferably, all of the capsules in the first set are velocity sensors having substantially zero response to acoustic pressure.

Preferably, each of at least three capsules in the first set of capsules is orientated such that its sensitivity in a direction at right angles to a line joining the capsule to the point of symmetry is larger than its sensitivity in either direction along said line. More preferably, all capsules in the first set of capsules are orientated such that their respective sensitivity in a direction at right angles to a line joining the capsule to the point of symmetry is larger than the sensitivity in either direction along said line. In this way, each capsule in the first set is oriented more tangentially than radially, such that its sensitivity at right angles to the line joining the capsule to the point of symmetry is larger than along the line. Amongst other advantages this moderates the tendency of any central acoustic obstruction to reduce the velocity sensitivity of the capsule.

It is further preferred that each of the least three capsules in the first set is orientated such its axis of maximum sensitivity is substantially a direction at right angles to the line joining the capsule to the point of symmetry. More preferably, all of the capsules in the first set are orientated such their respective axes of maximum sensitivity are substantially a direction at right angles to the line joining the capsule to the point of symmetry. In this way, each capsule in the first set is oriented tangentially, such that its axis of maximum sensitivity is substantially at right angles to a line joining the capsule to the point of symmetry. Amongst other advantages, this can allow the effective size of the array to be minimized, improving the high-frequency performance. Of course, within a plane normal to this line, there is still the freedom to select the actual direction of maximum response, providing that the directions of at least two of the capsules are non-coplanar.

It is also preferred that the disposition of the capsules in the first set is such that the centroid of their positions lies substantially at the point of symmetry.

In one implementation of the present invention, it is preferred that the first set of microphone capsules comprises at least four microphone capsules, wherein the at least four microphone capsules in the first set are disposed around the point of symmetry in a non-coplanar spatial arrangement. Such an arrangement provides for full capture of a surrounding sound field in three dimensions. Unlike known arrangements, at least some of the microphone capsules in this implementation of the present invention are both directional and orientated so as to point in a non-radial direction with respect to a point of symmetry, thereby avoiding unwanted acoustic cavities and associated resonances.

In another implementation of the present invention the at least three microphone capsules in the first set are disposed around the point of symmetry in a coplanar arrangement. Planar arrangements of directional microphones are sometimes used to achieve good audio reproduction in the horizontal plane. However, a planar arrangement according to the present invention, whereby the directions of maximum sensitivity of the microphones do not lie in the same plane, also provides for resolution in the vertical dimension.

Preferably, no two of the axes of the capsules in the first set intersect substantially at a point.

It is also preferred that the capsules in the first set are disposed at substantially equal distances from the point of symmetry, as this ensures better uniformity of response and simplifies processing of the captured audio signals.

For uniformity of response and to simplify the processing of the audio signals derived from each of the capsules, it is preferred that the capsules in the first set are disposed around the point of symmetry substantially in a configuration that is invariant under the actions of a symmetry group. The symmetry group can take many forms, including reflection, rotation and, in the case of a non-planar arrangement, polyhedral.

Further improvement in the overall acoustic response of the microphone array can be achieved by the inclusion of suitable acoustic obstructions within the array. For this reason it is preferred that the device further comprises an acoustic obstruction centred substantially on the point of symmetry. It is also preferred that the acoustic obstruction is substantially invariant under the actions of a symmetry group. The capsules may be placed in a range of positions with respect the acoustic obstruction, but it is preferred that each capsule in the first set is placed proximate to the surface of the obstruction.

Improvement in overall response can also be achieved by including other microphone capsules not directly associated with the first set of capsules. Therefore, it is preferred that the device further comprises a second set of one or more microphones capsules, at least one capsule of the second set having a response to acoustic pressure.

It is then preferred that the device is adapted to combine outputs from capsules in the second set to furnish a substantially omnidirectional response.

The device may be adapted to combine outputs from capsules in the first and second sets to substantially cancel an unwanted spherical harmonic signal at high audio frequencies.

Rather than employ a single acoustic obstruction within the array, it is possible to achieve similar benefits by employing distributed obstructions. For example, the device may further comprise a plurality of dummy capsules, wherein the second set of capsules and the plurality of dummy capsules are configured to obstruct the sound field in a manner that is substantially invariant under a symmetry group defined by the first set of capsules. Alternatively, the capsules of the second set may be embedded in the surface of an acoustic obstruction centred substantially on the point of symmetry. In this case it is again preferred that the acoustic obstruction and the second set of capsules are configured to obstruct the sound field in a manner that is substantially invariant under a symmetry group defined by the first set of capsules.

When dealing with three-dimensional, non-coplanar arrangements of capsules it is convenient to describe their optimised relative spatial disposition by reference to some underlying 3-dimensional shape, such as a polyhedron. The reference shape may be notional (virtual) construct or, in the case of an underlying frame or acoustic obstruction, an actual entity.

Preferably, the spatial disposition of the capsules in the first set is such that each capsule is located substantially on a different respective edge of a reference polyhedron. Preferably, the polyhedron is regular, although there may be applications in predominantly horizontal sound reproduction where a flattened polygonal arrangement may be optimal.

Preferably, each capsule in the first set is located substantially at the mid-point of the respective edge of the polygon. Each capsule may be oriented with respect to its polygon edge for optimal performance. It is then further preferred that each capsule in the first set is orientated such that the angle between the respective edge of the polyhedron and a projection of the direction of maximum sensitivity of the capsule onto a plane perpendicular to a line joining the point of symmetry to the capsule is substantially the same for all capsules in the first set. Preferably, the angle is not a multiple of $\pi/2$ radians.

Once a sound field has been sampled and captured by the microphone capsules in the array, it is then necessary to process the signals obtained to yield an audio reproduction with the desired directivities and (spherical) harmonic content over a particular audio frequency range.

Preferably, the device further comprises a matrix processor adapted to process outputs from the capsules so as to furnish at least two device outputs having different directivity patterns.

Preferably, the device further comprising a first matrix processor adapted to process outputs from the capsules to derive signals corresponding substantially to individual spherical harmonics of the sound field.

It is further preferred that the device comprises an equaliser adapted to apply frequency-dependent equalisation to the individual spherical harmonics such that harmonics of different orders arising from a distant sound source are equalised to have substantially constant relative levels over a substantial proportion of the audio frequency range.

It is finally preferred that the device further comprises a second matrix processor adapted to process the equalised harmonic signals so as to furnish at least one directional output signal having a directivity that is substantially constant over a substantial proportion of the audio frequency range.

In a further embellishment of the device, capsule in the first set may have attached to it a baffle arranged to reduce an asymmetry of disturbance caused by the capsule to the sound in the vicinity of the capsule. Thus the overall device may take account of its own impact on the sound field it is trying to capture.

As will appreciated by those skilled in the art, the present invention provides an improved sound capture device by employing an array of microphone capsules in an arrangement and orientation that at first sight might appear counter-intuitive, but which is in fact an effective and elegant solution to some of the problems associated with known arrays.

An audio signal captured using the sound capture device can be transmitted or encoded on any suitable data carrier. Preferably, a data carrier comprises an audio signal captured using the sound capture device of the present invention.

BRIEF DESCRIPTION OF THE DRAWINGS

Examples of the present invention will now be described in detail with reference to the accompanying drawings, in which.

DETAILED DESCRIPTION

Figure 1:
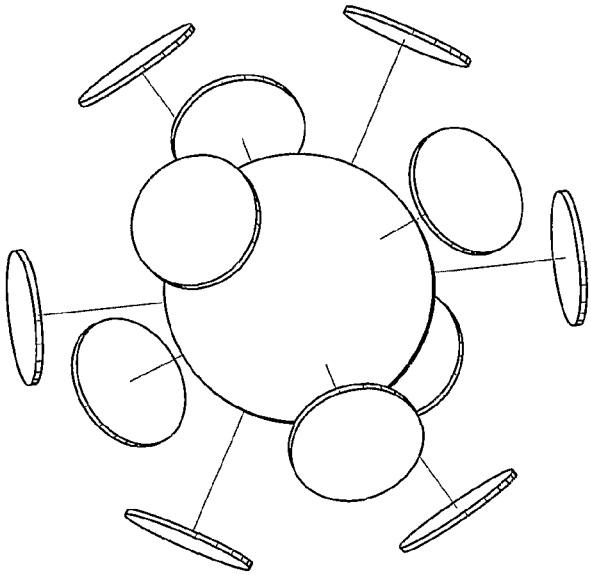
FIG. 1 PRIOR ART
FIG. 1 shows a known polyhedral arrangement of outward-pointing directional sensors.

The present invention addresses the problem of designing a microphone array that can extract directional information about the sound at a reference point in space, with directional characteristics that are maintained substantially constant over several octaves and with a good signal-to-noise ratio, as would be required for example for the studio or location recording of music.

The first systematic description of a method to do this is described by Craven, P. G. and Gerzon, M. A. in British patent GB1512514 ("Coincident microphone simulation covering three dimensional space and yielding various directional outputs" and by Gerzon, M. A. in "The Design of Precisely Coincident Microphone Arrays for Stereo and Surround Sound", Preprint L-20, 50th convention of the Audio Engineering Society (February 1975). These documents disclose the possibility of a sphere densely covered with microphones, or covered with a small number of strategically-placed microphone sensors. A suitable placement is the set of points of a 'good' integration rule on the sphere, of which a particular example is the set of midpoints of the faces of a regular polyhedron, such as the Platonic solids, namely the tetrahedron, cube, octahedron, dodecahedron and icosahedron.

Throughout this description, extensive use will be made of the notion of spherical harmonics. Spherical harmonics are functions defined on the surface of a sphere: an arbitrary function on the sphere can be expanded as a sum of spherical harmonics just as a function on a line can be expanded as a sum of sine waves. Spherical harmonics are grouped according to order, just as sine waves have a frequency. Low-order spherical harmonics alone will provide a gross, i.e. 'smeared' or 'spatially lowpass filtered', description of the original function, directional resolution increasing as harmonics of higher and higher orders are added. There is just one harmonic of order 0, three linearly independent harmonics of order 1, five of order 2, and in general (2n+1) linearly independent harmonics of order n. Furze and Malham have defined convenient basis functions for the harmonics of the first few orders and have provided them with alphabetic symbols. These basis functions $\phi$, normalised to have a mean-square value over the sphere of unity, are shown in table 1 below, together with their gradients.

The formula given for $\phi$ is valid only on the unit sphere $x^2+y^2+z^2=1$, but by extension it can be used as a function of direction, or as a function defined on the sphere-at-infinity, the triple (x, y, z) then being interpreted as direction cosines. We shall follow normal audio practice of considering the x-y plane as 'horizontal', while z represents the vertical direction.

To explain the operation of the microphone arrays, we ignore the finite distances of real sound sources and consider the sound field as being the superposition of sounds from point sources at infinity. Each such source generates a plane wave that travels though the air, the plane being normal to the direction of the source. The source distribution is thus described as a collection of discrete points on the sphere-at-infinity, and we now replace this description by a (possibly infinite) sum of spherical harmonics. It is the object of the invention to provide a microphone that will retrieve a suitable selection of these spherical harmonics.

For use in certain types of 3-D surround-sound reproduction known as "periphony", it is preferable to have available a complete set of signals corresponding to all harmonics up to and including n, for some integer n. For example, a "third order periphonic microphone" would be expected to provide sixteen (=1+3+5+7) signals corresponding to all the harmonics of orders 0, 1, 2 and 3. We shall mostly assume that such a complete set of signals is desired, though for some applications a smaller number of outputs can be provided, for example:

- For horizontal (2-D) surround-sound, it may be decided to dispense with some of the harmonics that provide resolution in the vertical direction. Such a second order microphone might dispense with Z, R, S and T, and provide only W, X, Y, U and V.
- For a directional "shotgun" mono microphone, a single output may be provided, consisting of a linear combination of one axisymmetric harmonic of each order. For example, W, Z and R are axisymmetric about the z-axis, and could be used to synthesise a directional microphone pointing in the z-direction.

Figure 8:
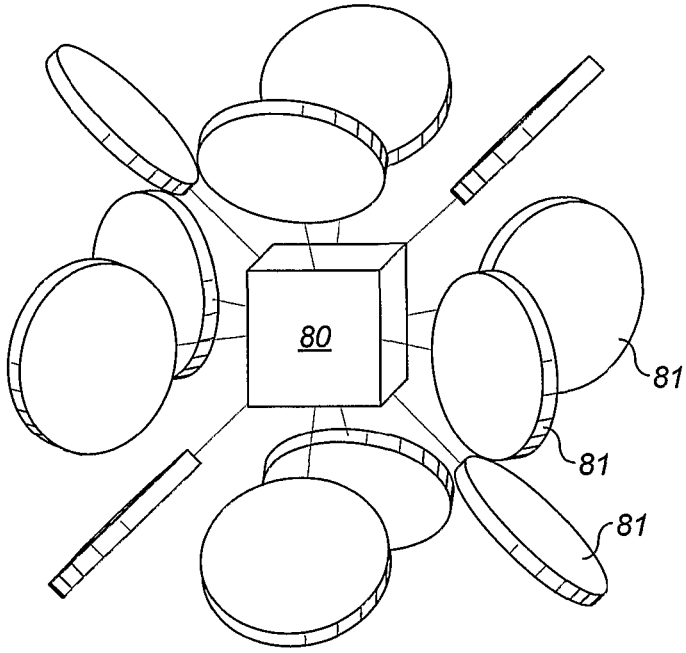
FIG. 8 shows a cubic array, with figure-of-eight axes normal to cube edges.

The way in which signals representing spherical harmonic components of a sound field can be combined (in a linear matrix) in order to produce desirable directional patterns has been discussed in the audio literature (for example, in FIG. 8 of Craven, Peter G.; Law, Malcolm J.; Stuart, J. Robert; Wilson, Rhonda J., "Hierarchical Lossless Transmission of Surround Sound Using MLP", Audio Engineering Society 24th International Conference (Banff, May 2003), paper #18) and so will not be considered further here.

A practical microphone has no means to access the 'sphere-at-infinity'. Accordingly, we consider a sphere of finite size, and make use of the fact that a hypothetical sound field created by sources at infinity, whose distribution is described by a single spherical harmonic, will create on the surface of a finite sphere a pressure distribution whose directionality follows the same spherical harmonic. A microphone to sense a particular order of spherical harmonic of the sound field can now be conceived, as disclosed in references Craven, P. G. and Gerzon, M. A., "Coincident microphone simulation covering three dimensional space and yielding various directional outputs" British patent GB1512514 (1977, filed July 1974) and Gerzon, M. A., "The Design of Precisely Coincident Microphone Arrays for Stereo and Surround Sound", Preprint L-20, 50th convention of the Audio Engineering Society (February 1975), as follows:

1. Cover a sphere with a suitable distribution of pressure sensors
2. Combine the sensor outputs so that, when the pressure distribution on the sphere is considered as a sum of spherical harmonic components, a signal proportional to the desired harmonic component is extracted with minimal contamination from other spherical harmonics
3. Determine and compensate for the known scaling factor between the harmonic component of the source distribution at infinity and the corresponding harmonic component of the resulting pressure distribution on the surface of the sphere, so that the output has the correct gain.

This method is illustrated in FIG. 1 of Gerzon, M. A., "The Design of Precisely Coincident Microphone Arrays for Stereo and Surround Sound", Preprint L-20, 50th convention of the Audio Engineering Society (February 1975), reproduced here as FIG. 2, which shows a collection of four capsules that implement step (1), a frequency-independent matrix that implements step (2) for several different spherical harmonics simultaneously, and equalisers that implement step (3) for each harmonic separately.

The scaling factor needed in step (3) is, in general, complex and frequency dependent: it depends on:

the wavelength of the sound;

the radius of the sphere;

whether the sphere is acoustically reflective (solid) or transparent (open);

and, the order of the spherical harmonic.

Figure 2:
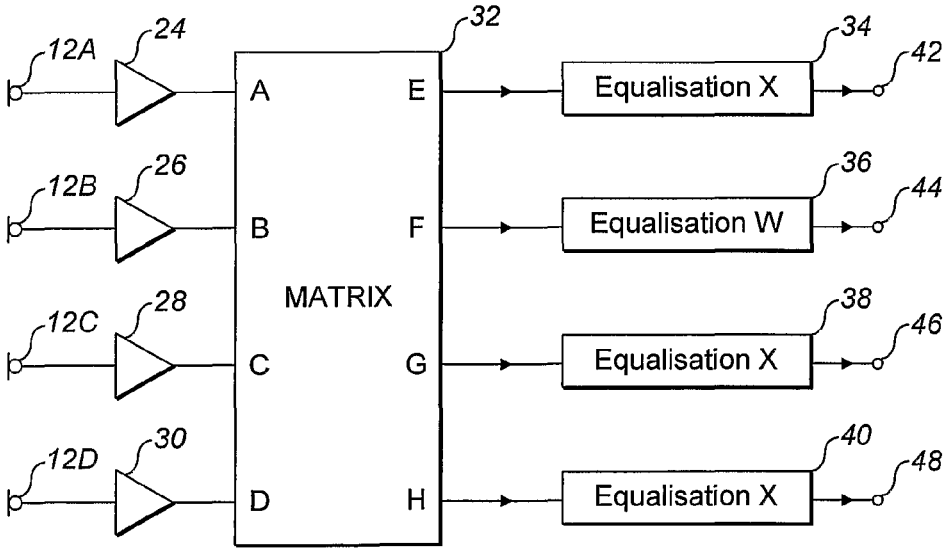
FIG. 2 PRIOR ART
FIG. 2 shows a known combination of capsule array, matrix processing and equalisation.

The calculation for this scaling factor has been considered in several recent papers, including Laborie, A; Bruno, R; Montoya, S, "A New Comprehensive Approach of Surround Sound Recording" Audio Eng. Soc. 114th Convention, February 2003, AES preprint #5717, Rafaely, B., "Design of a Second-Order Soundfield Microphone", Audio Eng. Soc. 118th Convention (Barcelona 2005), AES preprint #6405, and Meyer, J, "Beamforming for a circular microphone array mounted on spherically shaped objects", J. Acoust. Soc. Am. 109 (1), January 2001. For a particular order of harmonic, the scaling factor is a function of the ratio of the wavelength of the sound to the radius of the sphere. As illustrated in FIG. 2 of the Meyer paper, it has the general form of a bass cut with a slope of (6×n)dB/8 ve, where n is the order of the harmonic below a corner frequency. It has a gently falling response, with some 'wiggles', above the corner frequency. The corner frequency is in inverse relation to the radius of the sphere: in the simple case of a first order harmonic and a solid sphere, it is the frequency at which the wavelength equals $2\pi$ times the radius of the sphere. The corner frequency also increases slightly with increasing order of harmonic.

If n=2, the bass cut has a slope of 12 dB/8 ve. Hence the equaliser must provide a 12 dB/8 ve bass boost if a flat response is required on a second order harmonic output. If cost were not a consideration, then a large sphere, densely covered with microphone capsules, would allow the corner frequency to be placed at a frequency in the low hundreds of Hz, and the necessary boost at, say, 20 Hz might not then be excessive. With a smaller number of capsules, it is necessary to consider that the upper frequency limit for correct operation is related to the spacing between the capsules. So, for high-fidelity audio performance, the size of the sphere must be limited to a small number of centimeters and the corner frequency is likely to be within an octave or two of the upper frequency limit of, say, 20 kHz. As already mentioned, it may be impractical to maintain a 12 dB/8 ve boost over eight or ten octaves, and for this reason it does not seem attractive to use pressure sensors in order to provide a second order spherical harmonic output.

Accordingly, the invention is directed towards arrays that include capsules having a directional response. GB1512514 contemplates the use of directional capsules orientated radially outwards but, as already noted, such an arrangement suffers potential disadvantages including the possibility of a cavity resonance. The paper by Meyer discloses a circular array in which dipole (i.e. figure-of-eight) sensors are mounted with their directions of maximum sensitivity pointing along the circumference of the circle. This arrangement will substantially avoid cavity effects, but it is not useful for applications requiring a full set of first-order spherical harmonic outputs. Assuming the circle to lie in the horizontal x-y plane, then no capsule has a response to a 'Z' spherical harmonic, and hence it is not possible to provide a 'Z' output from the array.

Whether or not the capsules themselves all lie in one plane, it is preferred that their directions of maximum sensitivity be non-coplanar. To understand this, consider the coplanar case where each capsule has a response that is a linear combination of zeroth-order and first-order spherical harmonic components, and all first-order components are oriented in the x-y plane. If the array of capsules is now excited by a sound field in the form of a spherical harmonic that is axisymmetric about the z-axis, then by symmetry the first-order component of each of the capsules' responses will not be not excited. The array response will thus in this case be equivalent to the response of an array of pressure sensors, and the advantage of building an array from directional capsules will have been lost.

The invention therefore provides for an array of directional capsules whose directions of maximum sensitivity are non-coplanar and also are non-radial with respect to a point in the interior of the array.

Some embodiments of the invention make use of figure-of-eight capsules. However, if figure-of-eight capsules are used exclusively, there is no response to the zeroth-order spherical harmonic component of an incident sound field. Further capsules may be added to provide the missing zeroth-order response. For example, a single omnidirectional capsule may be placed at the centre of the array of figure-of-eight capsules.

Figure 3:
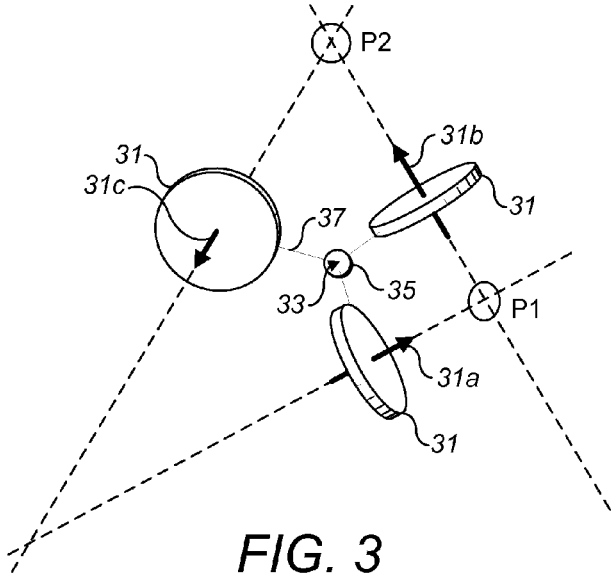
FIG. 3 shows a coplanar embodiment of the invention using three figure-of-eight capsules and central omni capsule.

An embodiment that uses three figure-of-eight capsules 31 with a central pressure sensor 30 is shown in FIG. 3. The figure-of-eight capsules 31 are disposed mutually at 120° around a central omnidirectional capsule 35, shown as a sphere, the sphere having a point of symmetry 33, and each capsule 31 associated with the central omnidirectional capsule 35 via a line 37. The figure-of-eight capsules are represented diagrammatically by discs 31: each has a maximum sensitivity in a direction normal to the plane of its disc illustrated as items 31 *a*, 31*b*, and 31*c*. All capsules lie in the same plane, which we shall call the x-y plane, but the directions of maximum sensitivity have been given a "twist" relative to the x-y plane. In this case the twist is clockwise as seen from the centre of the array or counter-clockwise as seen from the exterior. As shown in FIG. 3, which is a two dimensional or flat representation of the three dimensional reality of the figure-of-eight capsules 31, two points (P1 and P2) are shown which are apparent intersection points of different directions of maximum sensitivity (31*a* and 31*b* for point P1 and 31*b* and 31*c* for s point P2). Those skilled in the art will appreciate that these points are not intersection points in the three dimensional reality, but that they appear to be intersection points when viewed in the two dimensional or flat representation of FIG. 3. Without the twist, no capsule would respond to a Z spherical harmonic in the sound field, and hence the array would be unable to furnish a 'Z' output. With a twist of 90, it would be similarly be impossible to derive X and Y outputs. With an intermediate twist, all three first-order outputs X, Y and Z can be obtained using suitable matrix processing, the design of which is discussed later. A twist of $\tan-1(1/\sqrt{2})$ =35.3 approximately, has the property of equalising the signal-to-noise ratios of the X, Y and Z outputs.

Figure 4:
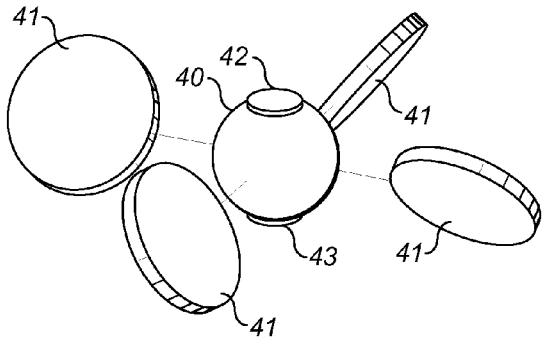
FIG. 4 shows an embodiment of the invention using four figure-of-eight capsules and central composite sensor having up-down symmetry.

While designed to capture first order harmonics, the array of FIG. 3 is also sensitive to second-order harmonics, which in practice will distort the polar diagrams at high audio frequencies. This problem is reduced for the horizontal first-order outputs X and Y if four figure-of-eight capsules 41 are used as shown in FIG. 4. The arrangement of FIG. 4 also addresses the point that practical "omnidirectional" microphones generally do not maintain perfectly isotropic responses to the highest audio frequencies. A cluster of several sensors, in a symmetrical arrangement, can provide better isotropy. For example, two identical axisymmetric capsules whose outputs are added, one upward-pointing and one downward-pointing, will provide a perfect 'W' omnidirectional response to horizontal sounds, because of rotational symmetry about the z-axis, and hence zero response to the first-order harmonics X and Y. These capsules could have nominally omnidirectional or cardioid responses, or any other axisymmetric response having a non-zero W component. In addition, because of the up-down symmetry, these capsules provide zero response to the first order Z spherical harmonic. In FIG. 4, two such outward-pointing capsules 42, 43 have been embedded in a central sphere 40.

A variation is to alternate the direction of twist as one goes round the circle. This variation is applicable to arrangements having an even number of figure-of-eight capsules.

Figure 5:
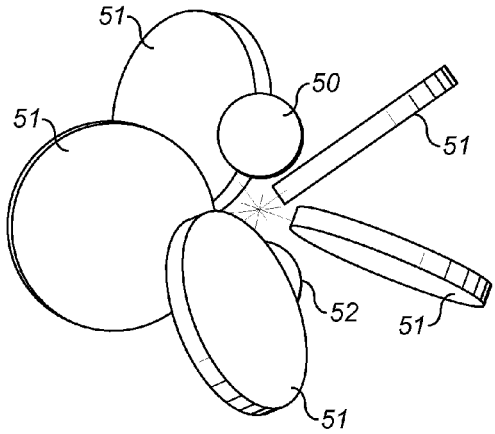
FIG. 5 shows a embodiment of the invention using five figure-of-eight capsules and two separated axisymmetric capsules.

An array using five figure-of-eight capsules 51, as shown in FIG. 5, can provide a further improvement to the accuracy of the horizontal polar diagrams of the X and Y outputs of a following matrix. In addition, it allows the matrix to derive the two 'horizontal' second-order harmonics U and V. A further feature of FIG. 5 is the separation of the central composite sensor into two capsules, 50 and 52, one capsule 50 above and one capsule 52 below the plane of symmetry. This design allows the figure-of-eight capsules to be placed so as almost to touch each other, this compactness maximising high-frequency performance for a given size of capsule.

A further variation is to derive some, or all, of the Z component from two axisymmetric capsules, by subtracting their outputs. This can allow the twist of the figure-of-eight capsules to be modified or dispensed with.

If accuracy in relation to horizontally-incident sound is the only consideration, the design of FIG. 5 may be very attractive. However the second-order R, S and T harmonics will 'contaminate' the desired lower-order outputs and, even if only the 'horizontal' harmonics W, X and Y are required as outputs, it may be preferred to use a 3-D capsule array as will now be described.

Figure 6:
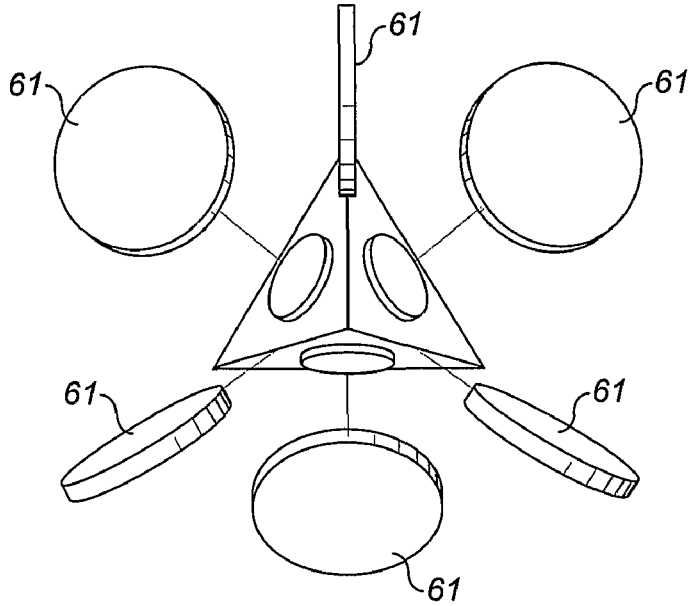
FIG. 6 shows a tetrahedral array, with figure-of-eight axes normal to tetrahedral edges.

A useful class of 3-D arrays according to the present invention is based on regular polyhedra. FIG. 6 shows an array with tetrahedral symmetry containing six figure-of-eight capsules 61, each mounted radially 'above' an edge of a central tetrahedron 60, with the plane of the capsule aligned parallel to the edge, so that its axis of symmetry, which is also its direction of maximum sensitivity, is normal to the edge and also normal to the radial line joining the centre of the tetrahedron to the centre of the capsule.

FIG. 6 is intended merely to convey the intended relative position and orientations of the capsules 61. They have been shown widely separated and on thin 'stalks' merely for clarity. A person skilled in the art will be able to conceive of suitable arrangements for mounting the capsules and for conveying a signal from each capsule, and will probably wish to place the capsules 61 closer together (relative to their sizes) than shown in FIG. 6. The mounting arrangement will necessarily cause acoustic obstruction, but this is not necessarily deleterious to the directional response provided that the symmetry of the array (in this case tetrahedral) is not broken. Another feature normally found in a practical microphone is a protective grille. Again, this should preferably not break the symmetry of the array.

As in the cases described previously, this array of figure-of-eight capsules will be unresponsive to a W sound field and it will normally be desired to supplement the array with one or more capsules having a response to pressure in order to provide a W signal. Any suitable arrangement of capsules may be used, including the ones already described in relation to FIGS. 3, 4 and 5. Another possibility is to use a symmetrical array of identical pressure sensors, for example by placing a sensor in the centre of each face of a central polyhedron. In FIG. 6 each pressure sensor is represented by a black disc attached to a face of the central tetrahedron. This has the advantage of maintaining tetrahedral symmetry, and of minimising any 'beaming' effects at high frequencies caused by the finite size of the pressure sensors, such that a W output obtained by adding the output of the four omni capsules will be uncontaminated by spherical harmonics of orders 1 and 2 in the incident sound field. In FIG. 6, the omni sensors are shown mounted on the faces of a solid central tetrahedron. Alternatively, the tetrahedron may be replaced by another shape having the same symmetry, or may be dissolved away to leave the capsules in free air. Yet another possibility is to embed the four tetrahedrally-positioned capsules in the surface of a solid sphere. These possibilities also apply to the other polyhedral arrangements to be discussed.

Before considering other arrangements, we describe how the coefficients of the matrix in FIG. 2 may be obtained. The essence of the method is as follows:

1. Excite the array with each desired spherical harmonic in turn, in each case recording the responses of all the capsules as a vector;
2. Assemble the vectors as a matrix A giving the capsule outputs in terms of the amplitudes of incident harmonics;
3. Obtain a pseudo-inverse $A^{-1}$ of A.; and
4. Matrix $A^{-1}$ may now be implemented in the matrix processor (FIG. 2) in order to furnish an estimate of the amplitude of each incident spherical harmonic This method is not essentially different from known methods that have been used to process the output of an array of pressure sensors.

In principle, step 1 could be performed as a physical experiment, but it will be convenient to analyse the situation theoretically, on the assumption of ideal sensors. In the case of pressure sensors, step 1 is performed simply by evaluating each desired spherical harmonic at the position of each sensor on the unit sphere.

For figure-of-eight sensors, we use the fact that these sense pressure gradient. The invention does not exclude the possibility that sensors may point in a direction intermediate between tangential and radial, in which case both tangential and radial components of gradient must be evaluated. Details relating to the analysis of the radial component can be found in the paper by Meyer. Here we shall consider just the tangential component, which is the only relevant component in the case of tangentially-pointing sensors.

For the arrangement of six figure-of-eight capsules shown in FIG. 6, their positions (x, y, z) and direction cosines (u, v, w) are given in table 2. The number allocated to each capsule is arbitrary and is for ease of reference. There is also an arbitrary choice of sign for the direction cosine: for the first capsule $$\frac{\sqrt{2}}{2}, 0, -\frac{\sqrt{2}}{2}$$

would have been a valid alternative to $$-\frac{\sqrt{2}}{2}, 0, \frac{\sqrt{2}}{2}.$$

This choice is equivalent to the choice of polarity of the capsule output: the matrix processing takes account of it, and the choice thereby has no effect on the final performance of the combination of capsule array and matrix.

Let us evaluate the response of capsule #2 to the S spherical harmonic We take the scalar product of the direction cosines of the capsule, $$\frac{\sqrt{2}}{2}, -\frac{\sqrt{2}}{2}, 0,$$

with the gradient of the spherical harmonic, given in the earlier table as ($\sqrt{15}$z, 0, $\sqrt{16}$x). This scalar product is $$\frac{\sqrt{15}\,z\sqrt{2}}{2}$$

and is be evaluated at the position of the capsule which is x=0, y=0, z=1, giving the result $$\frac{\sqrt{15}\sqrt{2}}{2}.$$

Proceeding in this way we can evaluate the responses, $resp_1$, $resp_2 \ldots resp_6$, of the six capsules when excited by a spherical harmonic. The response of the capsules is then given by the following expression:

$$\begin{bmatrix} resp_1 \\ resp_2 \\ resp_3 \\ resp_4 \\ resp_5 \\ resp_6 \end{bmatrix} = A \cdot \begin{bmatrix} w \\ x \\ y \\ z \\ r \\ s \\ t \\ u \\ v \end{bmatrix}$$

where w is the amplitude (scaling factor) of the W spherical harmonic component of the excitation, x is the amplitude of the X component, and so on, and where the matrix A, which relates the response of each capsule to the amplitude of each spherical harmonic component, is as follows:

$$A = \begin{bmatrix} 0 & 0 & -\frac{\sqrt{6}}{2} & -\frac{\sqrt{6}}{2} & 0 & -\frac{\sqrt{15}\sqrt{2}}{2} & 0 & 0 & -\frac{\sqrt{15}\sqrt{2}}{2} \\ 0 & -\frac{\sqrt{6}}{2} & \frac{\sqrt{6}}{2} & 0 & 0 & \frac{\sqrt{15}\sqrt{2}}{2} & -\frac{\sqrt{15}\sqrt{2}}{2} & 0 & 0 \\ 0 & 0 & -\frac{\sqrt{6}}{2} & \frac{\sqrt{6}}{2} & 0 & -\frac{\sqrt{15}\sqrt{2}}{2} & 0 & 0 & \frac{\sqrt{15}\sqrt{2}}{2} \\ 0 & -\frac{\sqrt{6}}{2} & 0 & -\frac{\sqrt{6}}{2} & 0 & 0 & -\frac{\sqrt{15}\sqrt{2}}{2} & 0 & -\frac{\sqrt{15}\sqrt{2}}{2} \\ 0 & -\frac{\sqrt{6}}{2} & -\frac{\sqrt{6}}{2} & 0 & 0 & -\frac{\sqrt{15}\sqrt{2}}{2} & -\frac{\sqrt{15}\sqrt{2}}{2} & 0 & 0 \\ 0 & -\frac{\sqrt{6}}{2} & 0 & \frac{\sqrt{6}}{2} & 0 & 0 & -\frac{\sqrt{15}\sqrt{2}}{2} & 0 & \frac{\sqrt{15}\sqrt{2}}{2} \end{bmatrix}$$

The first column of A consists of zeroes, that is to say the array has zero response to the W harmonic. This is a general properly of arrays of figure-of-eight capsules with tangential orientation, i.e. no sensitivity in the radial directions. The next three columns of A show a nonzero response to the three first order harmonics X, Y and Z. Then follow the five columns corresponding to the second-order harmonics. Two of these columns also are zero: the array is 'blind' to the R and U harmonics. The array does respond to the S, T and V harmonics, but the response to S is merely a scaled copy of the response to Y, and similarly with T and X and with V and Z. Therefore the S, T and V harmonics cannot be extracted independently of X, Y and Z, and indeed any X, Y and Z signals that might be extracted from this array will inevitably be contaminated by T, S and V, respectively.

From the matrix A one would deduce that the array has a higher sensitivity to the second order harmonics than to the first order harmonics X, Y and Z. In practice this sensitivity multiplies the "mode amplitudes" that are plotted in FIG. 2 of the Meyer paper. This plot relates to the case of capsules mounted on the surface of a solid sphere, but the results will not be qualitatively different if the sphere is absent, smaller, or replaced by a polyhedron. In the terminology of the Meyer paper, the second order harmonic is reduced by about 16 dB relative to the first order harmonic when the wavenumber k multiplied by the radius a is 0.5, i.e. when the wavelength is $4\pi$ times the radius of the sphere. With microphone arrays of a practical size, this would imply that the retrieved first order components are substantially contaminated by second order components at high audio frequencies, but not so at lower frequencies.

A candidate for the pseudo-inverse $A^{-1}$ is $A^T$, where T denotes a matrix transpose. This corresponds, for each desired spherical harmonic output signal, to weighting the output of each capsule proportionately to its response to that harmonic. The matrix relating the derived spherical harmonic signals to the original spherical harmonic excitation is then $A^T.A$, which for the six-capsule array discussed above is:

$$A^TA = \begin{bmatrix} 0 & 0 & 0 & 0 & 0 & 0 & 0 & 0 & 0 \\ 0 & 6 & 0 & 0 & 0 & 0 & 6\sqrt{5} & 0 & 0 \\ 0 & 0 & 6 & 0 & 0 & 6\sqrt{5} & 0 & 0 & 0 \\ 0 & 0 & 0 & 6 & 0 & 0 & 0 & 0 & 6\sqrt{5} \\ 0 & 0 & 0 & 0 & 0 & 0 & 0 & 0 & 0 \\ 0 & 0 & 6\sqrt{5} & 0 & 0 & 30 & 0 & 0 & 0 \\ 0 & 6\sqrt{5} & 0 & 0 & 0 & 0 & 30 & 0 & 0 \\ 0 & 0 & 0 & 0 & 0 & 0 & 0 & 0 & 0 \\ 0 & 0 & 0 & 6\sqrt{5} & 0 & 0 & 0 & 0 & 30 \end{bmatrix}$$

The top left 4×4 submatrix of this matrix shows us that the amplitudes x, y and z of the three first-order components will be correctly represented in the matrix outputs $resp_2$, $resp_3$ and $resp_4$ apart from a scaling factor of 6. However, the terms $6\sqrt{5}$ in the top right-hand corner represent contamination from second-order components, as already discussed.

Figure 7:
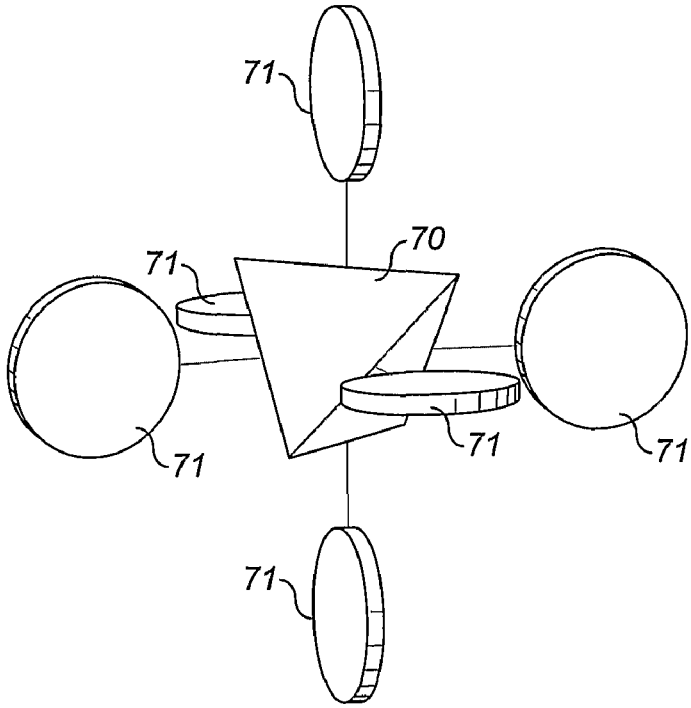
FIG. 7 shows a tetrahedral array with 45° twist.

In FIG. 6, the capsules 61 are orientated so that each has its axis perpendicular to the corresponding edge of the tetrahedron 60. Useful variants are obtained by rotating each capsule about its radial line so that is axis is still tangential. Applying a twist of 90° in this way, each capsule's axes will be parallel to the corresponding edge of the tetrahedron. The effect of this change on the matrix $A^T.A$ is to reverse the signs of the '$6\sqrt{5}$' terms. Between these two extremes, we can consider an arrangement with a twist of 45°, for example clockwise when viewed from the centre of the array or counterclockwise when viewed from the exterior. FIG. 7 shows such an example with capsules 71 orientated in this way with reference to tetrahedron 70. The corresponding matrix $A^T.A$ is:

$$A^TA = \begin{bmatrix} 0 & 0 & 0 & 0 & 0 & 0 & 0 & 0 & 0 \\ 0 & 6 & 0 & 0 & 0 & 0 & 0 & 0 & 0 \\ 0 & 0 & 6 & 0 & 0 & 0 & 0 & 0 & 0 \\ 0 & 0 & 0 & 6 & 0 & 0 & 0 & 0 & 0 \\ 0 & 0 & 0 & 0 & 0 & 0 & 0 & 0 & 0 \\ 0 & 0 & 0 & 0 & 0 & 30 & 0 & 0 & 0 \\ 0 & 0 & 0 & 0 & 0 & 0 & 30 & 0 & 0 \\ 0 & 0 & 0 & 0 & 0 & 0 & 0 & 0 & 0 \\ 0 & 0 & 0 & 0 & 0 & 0 & 0 & 0 & 30 \end{bmatrix}$$

showing that the '$6\sqrt{5}$' contamination terms have been cancelled. Thus, with a twist of 45°, $A^T$ provides a pseudo-inverse of A that allows signals corresponding to all first order harmonics and three of the five second harmonics to be retrieved. These signals are uncontaminated as long as the excitation is confined to zeroth, first and second order harmonics.

Figure 9:
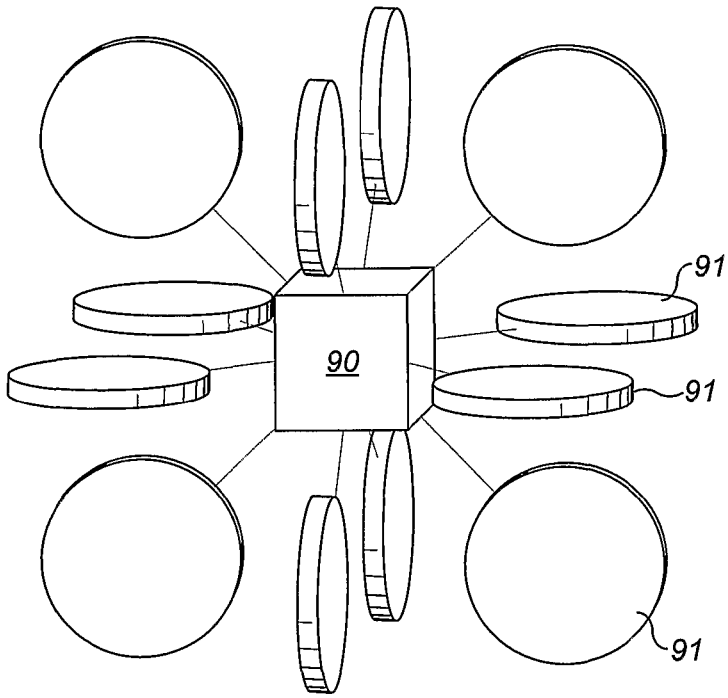
FIG. 9 shows a cubic array, with figure-of-eight axes parallel to cube edges.

FIG. 8 shows an arrangement that uses cuboidal symmetry, each of twelve capsules 81 being mounted 'above' an edge of the cube 80 with its axes of symmetry perpendicular to a radial line from the centre of the array to the capsule and also perpendicular to the edge. FIG. 9 shows a similar arrangement in which each capsule 91 has its axis of symmetry parallel to the edge of the cube 90, i.e. with a 'twist' of 90°. Proceeding as above we derive a matrix $A^T.A$ and we find that the arrangement of FIG. 8 is 'blind' to the second-order harmonics R and U, while the arrangement of FIG. 9 is blind to S, T and V. With a different assumed orientation of the underlying cube with respect to the x, y and z axes, the details of which harmonics cannot be 'seen' would be different, but it remains true that neither of the two arrangements is able to retrieve a full set of five linearly-independent second-order harmonics.

Figure 10:
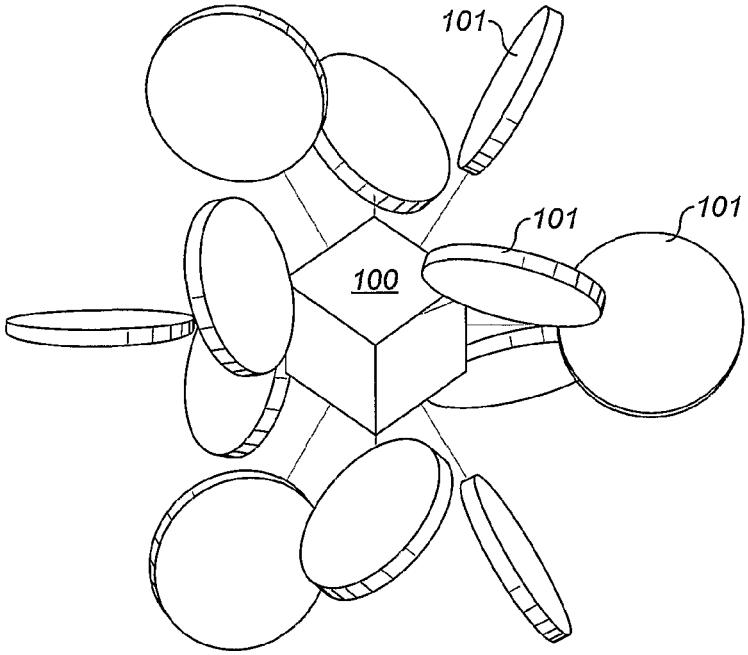
FIG. 10 shows a cubic array with 39° twist.

FIG. 10 is like FIG. 8 except that each capsule 101 disposed with reference to the cube 100 has been given a clockwise twist, when viewed from the exterior of the array (or counterclockwise when viewed from the centre), by an angle $\sin^{-1}(3/5))=\tan^{-1}(\sqrt{(\sqrt{2/3})}$, i.e. 39.2° degrees approximately. The matrix $A^T.A$ is now given by:

$$\begin{bmatrix} 0 & 0 & 0 & 0 & 0 & 0 & 0 & 0 & 0 \\ 0 & 12.0 & 0 & 0 & 0 & 0 & 0 & 0 & 0 \\ 0 & 0 & 12.0 & 0 & 0 & 0 & 0 & 0 & 0 \\ 0 & 0 & 0 & 12.0 & 0 & 0 & 0 & 0 & 0 \\ 0 & 0 & 0 & 0 & 36.0 & 0 & 0 & 0 & 0 \\ 0 & 0 & 0 & 0 & 0 & 36.0 & 0 & 0 & 0 \\ 0 & 0 & 0 & 0 & 0 & 0 & 36.0 & 0 & 0 \\ 0 & 0 & 0 & 0 & 0 & 0 & 0 & 36.0 & 0 \\ 0 & 0 & 0 & 0 & 0 & 0 & 0 & 0 & 36.0 \end{bmatrix}$$

showing 'perfect' retrieval of both first and second order harmonics. The second-order harmonics have a gain three times as great as the first-order harmonics, a fact that is easily allowed for in the matrix that follows the capsule array in FIG. 2.

If we also consider the seven third-order harmonics, we now find that the matrix $A^T.A$ is given by:

$$A^TA = \begin{bmatrix} 0, & 0, & 0, & 0, & 0, & 0, & 0, & 0, & 0, & 0, & 0, & 0, & 0, & 0, & 0, & 0 \\ 0, & 12.0, & 0, & 0, & 0, & 0, & 0, & 0, & 0, & 0, & 0, & 0, & 0, & 0, & 0, & 0 \\ 0, & 0, & 12.0, & 0, & 0, & 0, & 0, & 0, & 0, & 0, & 0, & 0, & 0, & 0, & 0, & 0 \\ 0, & 0, & 0, & 12.0, & 0, & 0, & 0, & 0, & 0, & 0, & 0, & 0, & 0, & 0, & 0, & 0 \\ 0, & 0, & 0, & 0, & 36.0, & 0, & 0, & 0, & 0, & 0, & 0, & 0, & 0, & 0, & 0, & 0 \\ 0, & 0, & 0, & 0, & 0, & 36.0, & 0, & 0, & 0, & 11.9, & 0, & -15.4, & 0, & 0, & 0, & 0 \\ 0, & 0, & 0, & 0, & 0, & 0, & 36.0, & 0, & 0, & 0, & 0, & 0, & 0, & 15.4, & 0, & 11.9 \\ 0, & 0, & 0, & 0, & 0, & 0, & 0, & 36.0, & 0, & 0, & 0, & 0, & 0, & 0, & 0, & 0 \\ 0, & 0, & 0, & 0, & 0, & 0, & 0, & 0, & 36.0, & 0, & 0, & 0, & 0, & 0, & -19.4, & 0 \\ 0, & 0, & 0, & 0, & 0, & 11.9, & 0, & 0, & 0, & 63.0, & 0, & 40.7, & 0, & 0, & 0, & 0 \\ 0, & 0, & 0, & 0, & 0, & 0, & 0, & 0, & 0, & 0, & 189.0, & 0, & 0, & 0, & 0, & 0 \\ 0, & 0, & 0, & 0, & 0, & -15.4, & 0, & 0, & 0, & 40.7, & 0, & 42.0, & 0, & 0, & 0, & 0 \\ 0, & 0, & 0, & 0, & 0, & 0, & 0, & 0, & 0, & 0, & 0, & 0, & 94.5, & 0, & 0, & 0, \\ 0, & 0, & 0, & 0, & 0, & 0, & 15.4, & 0, & 0, & 0, & 0, & 0, & 0, & 42.0, & 0, & -40.7 \\ 0, & 0, & 0, & 0, & 0, & 0, & 0, & 0, & -19.4, & 0, & 0, & 0, & 0, & 0, & 10.5, & 0 \\ 0, & 0, & 0, & 0, & 0, & 0, & 11.9, & 0, & 0, & 0, & 0, & 0, & 0, & -40.7, & 0, & 63.0 \end{bmatrix}$$

indicating that the retrieved second-order components are harmonic signals are contaminated by third-order signals. However, the retrieved first-order signals are not contaminated by third-order signals. In the language of audio engineers, the figure-of-eight outputs do not suffer, to first order at least, from 'beaming', i.e. sharper directivity at high frequencies.

An anticlockwise twist of 39.2° will be as effective as a clockwise twist, although the details of the individual matrices A and $A^T$ will be different.

Figure 11:
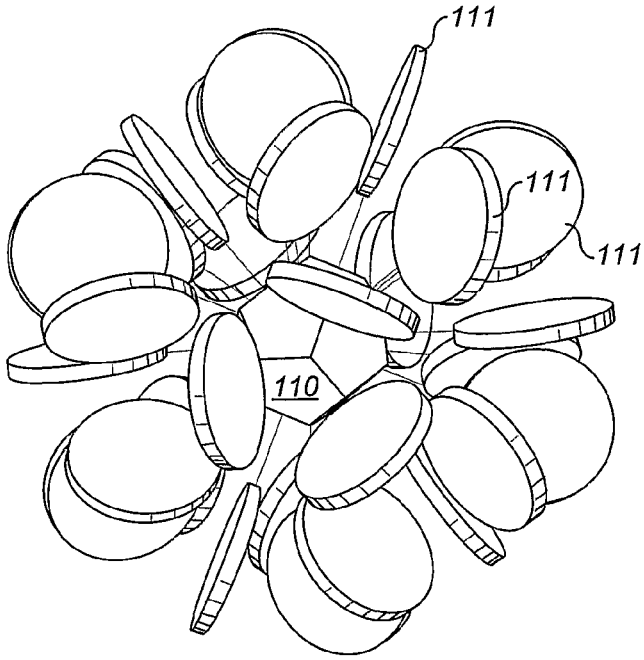
FIG. 11 shows a dodecahedral array, with figure-of-eight axes parallel to dodecahedron edges.

FIG. 11 shows an arrangement in which 30 capsules 111 are arranged around a regular dodecahedron 110, in this case each with its axis parallel to a corresponding edge. The matrix $A^T.A$, including third-order terms, is:

$$\begin{bmatrix} 0, & 0, & 0, & 0, & 0, & 0, & 0, & 0, & 0, & 0, & 0, & 0, & 0, & 0, & 0, & 0 \\ 0, & 30.0, & 0, & 0, & 0, & 0, & 0, & 0, & 0, & 0, & 0, & 0, & 0, & 0, & 0, & 0 \\ 0, & 0, & 30.0, & 0, & 0, & 0, & 0, & 0, & 0, & 0, & 0, & 0, & 0, & 0, & 0, & 0 \\ 0, & 0, & 0, & 30.0, & 0, & 0, & 0, & 0, & 0, & 0, & 0, & 0, & 0, & 0, & 0, & 0 \\ 0, & 0, & 0, & 0, & 0, & 90.0, & 0, & 0, & 0, & 0, & 0, & 0, & 0, & 0, & 0, & 0 \\ 0, & 0, & 0, & 0, & 0, & 0, & 0, & 0, & 0, & 0, & 0, & 0, & 0, & 0, & 0, & 0 \\ 0, & 0, & 0, & 0, & 0, & 0, & 90.0, & 0, & 0, & 0, & 0, & 0, & 0, & 0, & 0, & 0 \\ 0, & 0, & 0, & 0, & 0, & 0, & 0, & 90.0, & 0, & 0, & 0, & 0, & 0, & 0, & 0, & 0 \\ 0, & 0, & 0, & 0, & 0, & 0, & 0, & 0, & 90.0, & 0, & 0, & 0, & 0, & 0, & 0, & 0 \\ 0, & 0, & 0, & 0, & 0, & 0, & 0, & 0, & 0, & 354.1, & 0, & -142.4, & 0, & 0, & 0, & 0 \\ 0, & 0, & 0, & 0, & 0, & 0, & 0, & 0, & 0, & 0, & 5.7, & 0, & 0, & 0, & 0, & 0 \\ 0, & 0, & 0, & 0, & 0, & 0, & 0, & 0, & 0, & -142.4, & 0, & 64.0, & 0, & 0, & 0, & 0 \\ 0, & 0, & 0, & 0, & 0, & 0, & 0, & 0, & 0, & 0, & 0, & 0, & 107.4, & 0, & 176.1, & 0 \\ 0, & 0, & 0, & 0, & 0, & 0, & 0, & 0, & 0, & 0, & 0, & 0, & 0, & 404.9, & 0, & 54.4 \\ 0, & 0, & 0, & 0, & 0, & 0, & 0, & 0, & 0, & 0, & 0, & 0, & 176.1; & 0, & 310.7, & 0 \\ 0, & 0, & 0, & 0, & 0, & 0, & 0, & 0, & 0, & 0, & 0, & 0, & 0, & 54.4, & 0, & 13.2 \end{bmatrix}$$

From this we see that the choice of $A^T$ as pseudo-inverse of A retrieves the first and second harmonic signals 'perfectly', but the that there are off-diagonal elements in the last seven columns and rows of the matrix, showing that the third-order components have not been completely separated from each other. To separate these components we need a different pseudo-inverse, such as $$(A^T.A)^{-1}.A^T$$

a form well-known from the theory of least-squares solution of linear equations. We must now examine whether $(A^T.A)^{-1}$ exists and is well-conditioned, and to do this we examine the eigenvalues of $A^T.A$, shown here sorted by ascending numerical order:

[0.0, 5.7, 5.7, 5.7, 5.7, 30.0, 30.0, 30.0, 90.0, 90.0, 90.0, 90.0, 90.0, 412.3, 412.3, 412.3]

The first eigenvalue of 0 corresponds to the first-column and row of $A^T.A$, telling us that the zeroth-order signal W cannot be retrieved. Henceforth, we disregard the first eigenvalue (in practice we would delete the first column from A before starting the analysis), since the W signal can be derived using pressure sensors as already described.

The three eigenvalues of 30 and the five eigenvalues of 90 correspond to the diagonal elements of $A^T.A$ that have these values, in turn corresponding to the first and second-order harmonics. The four eigenvalues of 5.7 and the three of 412.3 arise from the last seven rows and columns of $A^T.A$, corresponding to the third-order harmonics. These harmonics can theoretically be completely resolved, but the large range of eigenvalues '5.7' to '412.3' indicates an ill-conditioned problem, in practice resulting in excessive amplification of noise and any non-identical features of the microphone capsules.

Applying the same analysis but with the capsule axis orientation of perpendicular to the edges of the underlying dodecahedron results in the eigenvalues:

[0, 30.0, 30.0, 30.0, 60.2, 60.2, 60.2, 90.0, 90.0, 90.0, 90.0, 90.0, 269.9, 269.9, 269.9, 269.9]

Figure 12:
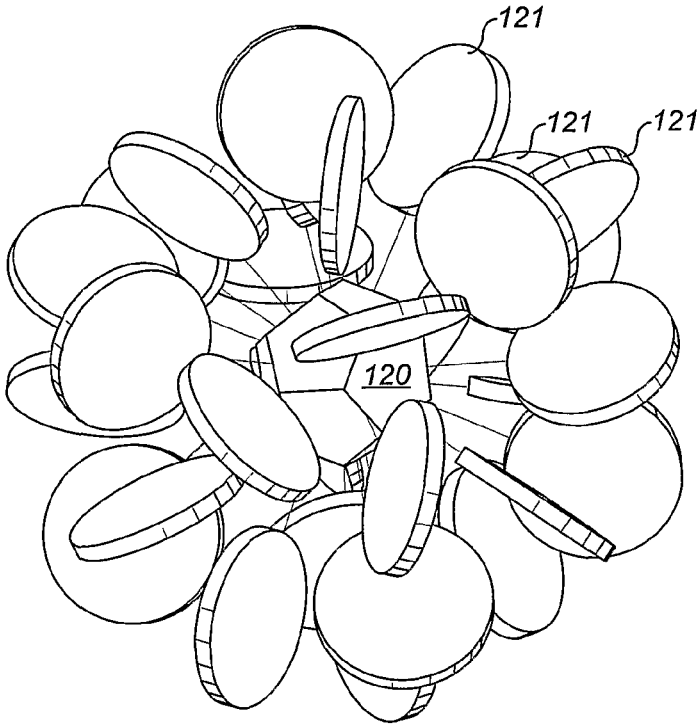
FIG. 12 shows a dodecahedral array with 35.7° twist.

The spread of the third-order eigenvalues is now 60.2 to 269.9, which is a much less disadvantageous situation than with the parallel orientation. The eigenvalue spread can be reduced further by applying a twist. Indeed, the spread of third-order eigenvalues can be reduced to zero by using a twist of approximately 35.69° relative to the perpendicular orientation, as shown for the capsules 121 disposed relative to the dodecahedron 120 in FIG. 12. The eigenvalues of $A^T.A$ to third order are now:

[0.0, 30.0, 30.0, 30.0, 90.0, 90.0, 90.0, 90.0, 90.0, 180.0, 180.0, 180.0, 180.0, 180.0, 180.0, 180.0]

showing ideal reconstruction of the third-order harmonics using $(A^T.A)^{-1}.A^T$ as the pseudo-inverse of A. Analysing to fourth order, we find for the eigenvalues:

[0.0, 30.0, 30.0, 30.0, 90.0, 90.0, 90.0, 90.0, 90.0, 171.0, 171.0, 171.0, 171.0, 180.0, 180.0, 180.0, 247.5, 247.5, 247.5, 247.5, 247.5, 374.5, 374.5, 374.5, 374.5]

This indicates a somewhat more complicated situation. Nevertheless, the spread of eigenvalues corresponding to the third-order and fourth-order harmonics is not excessive. Hence, it should be possible to use $(A^T.A)^{-1}.A^T$ as a pseudo inverse to retrieve harmonics of orders 1, 2, 3 and 4 from this array, without excessive amplification of noise etc. (other than the amplification that is inevitable at low frequencies as already discussed). There are 24 such harmonics, indicating that we have made 'efficient' use of the information from the 30 capsules 121 in the array of FIG. 12.

Precise analysis of the way the geometrical construction of an array affects its response is not straightforward. As well as considering whether there is a central solid such as a sphere or a polyhedron, we also need to consider that sensors are not acoustically transparent and each one affects the sound picked up by the others. In general, the design of the equalisers shown in FIG. 2 will require either complicated numerical modelling of the acoustics of the array, or an experimental determination of the unequalised response. It is extremely helpful, however, if the individual spherical harmonics can be separated without such detailed modelling. An advantage of an array having a high degree of symmetry, such as an array based on a regular polyhedron, is that symmetry arguments can be used to show that the details of the acoustic arrangement do not impair the separation of low-order harmonics, as long as the symmetry is maintained.

It would be normal to arrange for the equalisation shown in FIG. 2 to equalise the spherical harmonic signals to have an approximately flat frequency response over the majority of the audio frequency range, or at least so that the signals have substantially the same frequency response. This simplifies the design of any further processing that synthesises a desired directional pattern (polar response) from the harmonic signals provided by the invention, and helps to ensure that the directional pattern thus obtained remains substantially constant over a frequency range. However, it may be desirable to restrict the frequency range of higher-order harmonics, in order to reduce signal-to-noise ratio problems at low frequencies and contamination effects at high frequencies. Because of symmetry, the same equalisation curve should be applicable to all harmonics of a given order.

Figure 13:
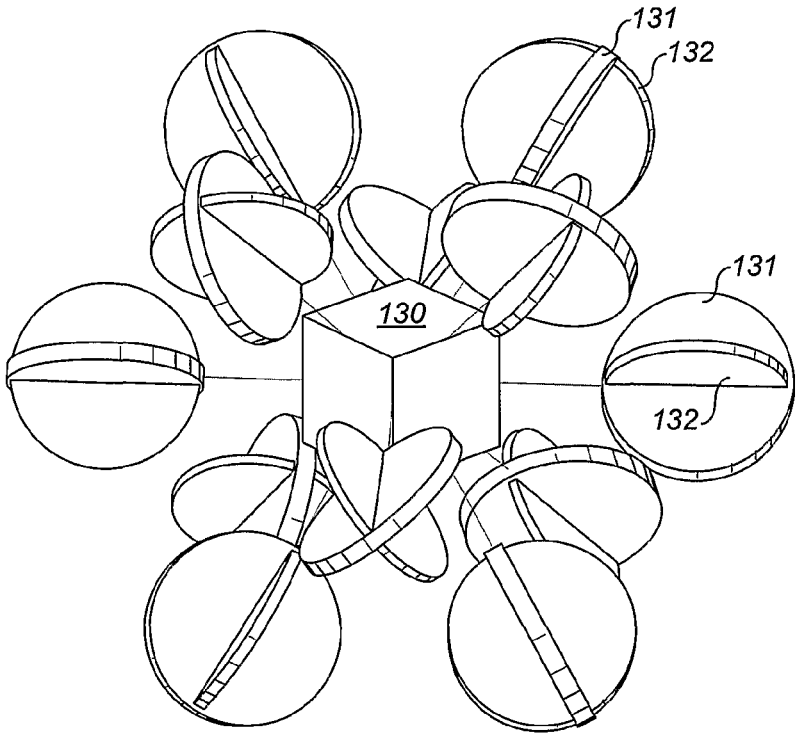
FIG. 13 shows a cubic array with 39° twist and symmetry-improving baffles.

Theoretically, a 'twist' (other than a twist of) 90° breaks reflective symmetry. This is not a problem with the idealised case of acoustically transparent capsules that sense air velocity without disturbing it, but with real capsules that do disturb the air flow, a twist potentially invalidates some of the symmetry arguments that have been used above. However, a sensor that is spherically symmetric, rather than having a disc-like shape, would not incur this problem. One way to make a disc-shaped sensor behave acoustically more like a sphere is to add a further disc or discs. FIG. 13 shows such an array similar to the array of FIG. 10 referenced to a cube 130, but where each sensor 131 has been augmented with a passive baffle 132 in order that the obstruction to air flow along the axis of symmetry of the sensor is approximately the same as the obstruction in the orthogonal tangential direction.

Capsule arrangements that have rotational symmetry about multiple axes include the arrangements of FIGS. 3, 4, and 5, which have an n-fold rotational symmetry around the z-axis, where n is 3, 4 and 5, respectively, and also a 180° rotational symmetry about n different axes lying in the x-y plane. Each of these symmetries is described mathematically by a finite symmetry group, such that the arrangement of capsules is invariant under the actions of the group. A capsule arrangement based on a regular polyhedron is similarly invariant under the actions of the relevant polyhedral group. A capsule arrangement may thus be said to 'define' a symmetry group under the actions of which it is invariant.

A point of symmetry is a point that is invariant under all the symmetry operations defined by the symmetry group of the capsule array. In the preferred embodiments, the centroid of the positions of the capsules is a point of symmetry. In some embodiments there is an acoustically opaque solid providing acoustic obstruction and centred on the point of symmetry. Such an acoustic obstruction may be helpful in controlling the frequency dependent aspects of the array, and it may be advantageous to make the obstruction as large as is practical, subject to it not substantially covering velocity sensors, so that the sensors are close to or touching the surface of the obstruction. The acoustic obstruction should preferably be invariant under some or all of the symmetry groups defined by the capsule array. As already noted, it may be convenient to mount pressure sensors on or in the acoustic obstruction, in order to respond to the W harmonic. In this case the pressure sensors themselves provide acoustic obstruction. It may be desirable to provide additional 'dummy capsules' in order to provide an increased order of symmetry, for example augmenting a tetrahedral arrangement of four pressure sensors by four further externally similar dummy capsules, so that combination has hexahedral/octahedral symmetry. This may be advantageous for use in combination with an array of capsules placed on the midpoints of the edges of a cube, which also has hexahedral/octahedral symmetry.

Another embodiment of the invention uses more than one concentric array of capsules, for example an outer array to sense lower audio frequencies and an inner array to sense higher audio frequencies. The various arrays may have the same or different symmetry properties as each other, or as a centrally-placed arrangement of omnidirectional capsules used to retrieve the W signal. Each symmetrical array defines a point of symmetry, and it would be usual to have the various points of symmetry close to each other so as to provide an effective point of symmetry for the device as a whole. A 'W' signal obtained from a centrally-placed arrangement of omnidirectional capsules will generally be relatively uncontaminated by higher order harmonics. Nevertheless, it may be advantageous to correct the derived W signal using signals from the velocity sensors in order to cancel or reduce contaminating higher order signals, and this possibility may be further assisted if the arrangement of omnidirectional capsules and the arrangement of velocity capsules share some symmetry.

While the 'Platonic' regular solids provide excellent symmetry properties, the invention allows other arrangements having lower degrees of symmetry. An example of a non-coplanar arrangement having lower symmetry is a 'squashed' regular polyhedron, in which a polyhedron that has rotational symmetry about the z-axis has the capsules moved according to a transformation $z \rightarrow f(z)$ for some function f, which can be linear or nonlinear. When f is nonlinear and asymmetric, the resulting array will have only one axis of rotational symmetry. Capsule arrangements can also be based on non-Platonic regular solids, such as the icosadodecahedron, or the cuboctahedron.

Capsule arrangements based on the cube and on the octahedron are not essentially different. The two solids are duals of each other and share the same number of edges, namely twelve. An arrangement of capsules with axes parallel to the edges of a cube is the same an arrangement of capsules with axes perpendicular to the edges of a regular octahedron. The one arrangement can thus be transformed into the other by increasing the angle of twist by 90° ($\pi/2$ radians). Similar considerations apply to the dodecahedron and the icosahedron, which have 30 edges each. When using a twist, it will generally be desirable to use the same twist angle for each capsule, in order to preserve the symmetry as far as possible.

We have described a simple derivation of a pseudo-inverse of matrix A in relation to the polyhedral case. The same methods are applicable to other configurations including the coplanar array discussed earlier. A person skilled in the art of numerical analysis will know that other methods are possible. For example, it would be possible to require the retrieval of certain spherical harmonic signals, while minimising the contamination from specified other harmonics having an assumed mean-square amplitude. This minimisation is easily performed using the known methods of numerical linear algebra.

The invention can also make use of other types of sensor, for example a dual sensor that responds to air velocity in two directions simultaneously. Such a sensor is equivalent to two sensors that happen to be at the same point but have their directions of maximum sensitivity pointing in different directions, and they would be treated as such in deriving the pseudo-inverse of A. One embodiment of the invention places such dual sensors on the edges of a reference polyhedron, so that the components of air velocity parallel and perpendicular to the polyhedron edges are available simultaneously as two outputs. In this case the "twist" is unnecessary and irrelevant, because although each individual output from the sensor has a direction of maximum sensitivity, the two outputs taken together provide equally good information from any direction in the plane. Similarly because there is no preferred direction, it is possible to place such sensors at the vertices of a polyhedron or at the centres of its faces while still taking full advantage of the underlying symmetry of the polyhedron.

The methods described for deriving the pseudo-inverse of A could also be used to integrate outputs from pressure and velocity sensors, for example velocity sensors that measure velocity along the edges of a polyhedron, while pressure sensors measure pressure at the midpoints of its faces. In general this requires a frequency-dependent computation, since the pressure and velocity sensors will have different high-frequency responses, depending on the precise geometrical arrangement.

TABLE 1

Spherical Harmonic basis functions

| Order | Symbol | Value $\phi$ | Gradient $\left(\frac{\partial}{\partial x}\phi, \frac{\partial}{\partial y}\phi, \frac{\partial}{\partial z}\phi\right)$ |
|---|---|---|---|
| 0 | W | 1 | (0, 0, 0) |
| 1 | X | $\sqrt{3}\,x$ | $(\sqrt{3}, 0, 0)$ |
| | Y | $\sqrt{3}\,y$ | $(0, \sqrt{3}, 0)$ |
| | Z | $z\sqrt{3}$ | $(0, 0, \sqrt{3})$ |
| 2 | R | $\frac{\sqrt{5}\,(3z^2-1)}{2}$ | $(0, 0, 3z\sqrt{5})$ |
| | S | $\sqrt{15}\,xz$ | $(\sqrt{15}z, 0, \sqrt{15}x)$ |
| | T | $\sqrt{15}\,yz$ | $(0, \sqrt{15}z, \sqrt{15}y)$ |
| | U | $\frac{\sqrt{15}\,(x^2-y^2)}{2}$ | $(\sqrt{15}\,x, -\sqrt{15}\,y, 0)$ |
| | V | $\sqrt{15}\,xy$ | $(\sqrt{15}\,y, \sqrt{15}\,x, 0)$ |
| etc. | | ... | |

TABLE 2

Positions and Direction Cosines for the arrangement capsules shown in figure 6

| Capsule # | Position x, y, z | Direction cosines u, v, w |
|---|---|---|
| 1 | 0, 1, 0 | $-\frac{\sqrt{2}}{2}, 0, \frac{\sqrt{2}}{2}$ |
| 2 | 0, 0, 1 | $\frac{\sqrt{2}}{2}, -\frac{\sqrt{2}}{2}, 0$ |
| 3 | 1, 0, 0 | $0, \frac{\sqrt{2}}{2}, -\frac{\sqrt{2}}{2}$ |
| 4 | 0, 0, −1 | $\frac{\sqrt{2}}{2}, \frac{\sqrt{2}}{2}, 0$ |
| 5 | −1, 0, 0 | $0, \frac{\sqrt{2}}{2}, \frac{\sqrt{2}}{2}$ |
| 6 | 0, −1, 0 | $-\frac{\sqrt{2}}{2}, 0, -\frac{\sqrt{2}}{2}$ |

The invention claimed is:

1. A sound capture device comprising a plurality of microphone capsules and providing directional information about sound at a reference point, the plurality of microphone capsules comprising:

a first set of directional microphone capsules disposed around their centroid, the first set having at least three directional microphone capsules, each directional microphone capsule in the first set having an axis along which it exhibits maximum intrinsic sensitivity, wherein the directions of the axes of the directional microphone capsules in the first set are not all coplanar, said first set of directional microphone capsules arranged such that there are no two points which together are intersected by all of said axes of maximum intrinsic sensitivity and such that there is no single point intersected by all of said axes of maximum intrinsic sensitivity.

2. The sound capture device according claim 1, wherein said first set has at least five directional microphone capsules.

3. The sound capture device according claim 1, wherein said first set has at least six directional microphone capsules.

4. The sound capture device according claim 1, wherein at least three of said directional microphone capsules in said first set are each orientated such that their sensitivity is larger in a direction at right angles to a line joining the respective directional microphone capsule to the centroid than it is in either direction along said line.

5. The sound capture device according claim 4, wherein said at least three directional microphone capsules in said first set are orientated such that the axis of maximum intrinsic sensitivity of each of these directional microphones is at right angles to a line joining the respective directional microphone capsule to the centroid.

6. The sound capture device according to claim 1, wherein at least three microphone capsules in the first set are velocity sensors having zero response to acoustic pressure.

7. The sound capture device according to claim 1, wherein at least three of the axes of maximum intrinsic sensitivity do not pass through any point of symmetry of the first set of directional microphone capsules.

8. The sound capture device according to claim 1, wherein no two of the axes of maximum intrinsic sensitivity intersect at a point.

9. The sound capture device according to claim 1, wherein positions of the directional microphone capsules in the first set are coplanar.

10. The sound capture device according to claim 1, wherein the first set comprises at least four directional microphone capsules, and wherein the positions of the at least four capsules are not coplanar.

11. The sound capture device according to claim 1, wherein the directional microphone capsules in the first set lie on a reference surface of revolution.

12. The sound capture device according to claim 11, wherein the reference surface of revolution is the surface of a reference spheroid.

13. The sound capture device according to claim 1, wherein the directional microphone capsules in the first set are disposed at equal distances from a point.

14. The sound capture device according to claim 1, wherein the directional microphone capsules in the first set are disposed in an arrangement that does not define a nontrivial symmetry group.

15. The sound capture device according to claim 14, the device further comprising an acoustic obstruction.

16. The sound capture device according to claim 15, wherein each directional microphone capsule in the first set is placed proximate to a surface of the acoustic obstruction.

17. The sound capture device according to claim 16, wherein each directional microphone capsule in the first set is orientated such that its axis of maximum intrinsic sensitivity makes an angle of less than 45 degrees with the local surface of the acoustic obstruction.

18. The sound capture device according to claim 17, wherein each directional microphone capsule in the first set is orientated such that its axis of maximum intrinsic sensitivity is tangential to the local surface of the acoustic obstruction.

19. The sound capture device according to claim 1, wherein the directional microphone capsules in the first set are disposed in an arrangement that defines a nontrivial symmetry group.

20. The sound capture device according to claim 19, wherein the nontrivial symmetry group is a dihedral group.

21. The sound capture device according to claim 19, wherein the nontrivial symmetry group is a polyhedral group.

22. The sound capture device according to claim 21, wherein the first set comprises at least six directional microphone capsules and wherein each directional microphone capsule in the first set is located on a different respective edge of a reference regular polyhedron.

23. The sound capture device according to claim 22, wherein each directional microphone capsule in the first set is located substantially at the mid-point of the respective edge.

24. The sound capture device according to claim 22, wherein each directional microphone capsule in the first set is orientated such that the angle between its axis of maximum intrinsic sensitivity and the respective edge of the polyhedron is the same for all directional microphone capsules in the first set.

25. The sound capture device according to claim 24, wherein the angle is neither 0 degrees nor 90 degrees.

26. The sound capture device according to claim 19, the device further comprising an acoustic obstruction centered substantially on a point of symmetry of the first set of directional microphone capsules.

27. The sound capture device according to claim 26, wherein the acoustic obstruction is invariant under the actions of the symmetry group.

28. The sound capture device according to claim 26, wherein each directional microphone capsule in the first set is placed proximate to a surface of the acoustic obstruction.

29. The sound capture device according to claim 28, wherein each directional microphone capsule in the first set is orientated such that its axis of maximum intrinsic sensitivity makes an angle of less than 45 degrees with the local surface of the acoustic obstruction.

30. The sound capture device according to claim 29, wherein each directional microphone capsule in the first set is orientated such that its axis of maximum intrinsic sensitivity is tangential to the local surface of the acoustic obstruction.

31. The sound capture device according to claim 1, wherein each directional microphone capsule in the first set has attached to it a baffle arranged to reduce an asymmetry of disturbance caused by the directional microphone capsule to the sound in the vicinity of the directional microphone capsule.

32. The sound capture device according to claim 1, wherein the plurality of microphone capsules comprises a second set of one or more microphone capsules, at least one microphone capsule of the second set having a response to acoustic pressure.

33. The sound capture device according to claim 32, wherein at least four microphone capsules of the second set have a response to acoustic pressure.

34. The sound capture device according to claim 32, wherein the number of microphone capsules in the second set having a response to acoustic pressure is selected from the group consisting of one, two, three, four, six, eight, twelve, fourteen, twenty and thirty-two.

35. The sound capture device according to claim 32, wherein the device is adapted to combine outputs from microphone capsules in the second set to furnish an omnidirectional response.

36. The sound capture device according to claim 32, wherein the directional microphone capsules in the first set are disposed in an arrangement that defines a nontrivial symmetry group, the device further comprising at least a first dummy capsule, wherein the second set of microphone capsules and the at least first dummy capsule are configured to together obstruct the sound field in a manner that is invariant under the actions of the symmetry group.

37. The sound capture device according to claim 32, wherein the directional microphone capsules in the first set are disposed in an arrangement that defines a nontrivial symmetry group, the device further comprising at least a first dummy capsule and an acoustic obstruction, wherein the second set of microphone capsules, the at least first dummy capsule and the acoustic obstruction are configured to together obstruct the sound field in a manner that is invariant under the actions of the symmetry group.

38. The sound capture device according to claim 32, wherein the directional microphone capsules in the first set are disposed in an arrangement that does not define a nontrivial symmetry group, the device further comprising an acoustic obstruction, wherein the microphone capsules in the second set are mounted on or embedded in the surface of the acoustic obstruction.

39. The sound capture device according to claim 32, wherein the directional microphone capsules in the first set are disposed in an arrangement that defines a nontrivial symmetry group, the device further comprising an acoustic obstruction centred substantially on a point of symmetry of the first set of directional microphone capsules, wherein the microphone capsules in the second set are mounted on or embedded in the surface of the acoustic obstruction.

40. The sound capture device according to claim 32, wherein the device is adapted to combine outputs from directional microphone capsules in the first set with outputs from microphone capsules in the second set in a frequency-dependent manner.

41. The sound capture device according to claim 32, wherein the device is adapted to combine outputs from directional microphone capsules in the first set with outputs from microphone capsules in the second set to reduce an amplitude of an unwanted spherical harmonic signal at high audio frequencies.

42. The sound capture device according to claim 1, wherein the device is adapted to process outputs from the plurality of microphone capsules so as to furnish at least one directional output signal having a directivity that is constant over three or more octaves of the audio frequency range.

43. The sound capture device according to claim 1, wherein the device is adapted to furnish at least one output signal having at least second-order directivity.

44. The sound capture device according to claim 1, the device further comprising a matrix processor adapted to process outputs from the plurality of microphone capsules so as to furnish at least two device outputs having different directivity patterns.

45. The sound capture device according to claim 1, the device further comprising a first matrix processor adapted to process outputs from the plurality of microphone capsules to derive signals corresponding to individual spherical harmonics of the sound field.

46. The sound capture device according to claim 45, the device further comprising an equalizer adapted to apply frequency-dependent equalization to the individual spherical harmonics such that harmonics of different orders arising from a distant sound source are equalized to have constant relative levels over three or more octaves of the audio frequency range.

47. A sound capture device comprising a plurality of microphone capsules and providing directional information about sound at a reference point, the plurality of microphone capsules comprising a first set of directional microphone capsules disposed around their centroid, the first set having at least five directional microphone capsules, each directional microphone capsule in the first set having an axis along which it exhibits maximum intrinsic sensitivity, wherein the directions of the axes of the directional microphone capsules in the first set are not all coplanar;

said first set of directional microphone capsules arranged such that the directions of the axes of the capsules in the first set are not all coplanar, and that there is no single point intersected by all of said axes of maximum intrinsic sensitivity.

48. A sound capture device comprising a plurality of microphone capsules and providing directional information about sound at a reference point, the plurality of microphone capsules comprising:

a first set of at least three directional microphone capsules disposed around their centroid in a coplanar arrangement, said arrangement defining a nontrivial symmetry group and having an axis of rotational symmetry that is perpendicular to the plane of the capsules, each directional microphone capsule having an axis along which it exhibits maximum intrinsic sensitivity, wherein none of the axes of maximum intrinsic sensitivity intersect said axis of rotational symmetry, and none of the axes of maximum intrinsic sensitivity are parallel to or perpendicular to said axis of rotational symmetry.

* * * * *